United States Patent [19]

Goldfarb et al.

[11] 4,300,762

[45] Nov. 17, 1981

[54] SURPRISE ACTION GAME

[75] Inventors: Adolph E. Goldfarb, 4614 Monarca Dr., Tarzana, Calif. 91356; Howard L. Dekan, Oxnard, Calif.

[73] Assignee: Adolph E. Goldfarb, Tarzana, Calif.

[21] Appl. No.: 121,644

[22] Filed: Feb. 14, 1980

[51] Int. Cl.[3] ..... A63F 9/00

[52] U.S. Cl. ..... 273/1 GC; 273/1 GG

[58] Field of Search ..... 273/1 E, 1 R, 375, 384, 273/379, 1 GC, 1 GG; 340/399

[56] References Cited

U.S. PATENT DOCUMENTS

| | | | |
|---|---|---|---|
| 3,547,436 | 12/1970 | Breslow | 273/1 E |
| 3,722,124 | 3/1973 | Nathanson et al. | 273/375 X |
| 4,039,184 | 8/1977 | Breslow et al. | 273/1 E |
| 4,212,412 | 7/1980 | Ikeda | 273/384 X |

FOREIGN PATENT DOCUMENTS

| | | | |
|---|---|---|---|
| 2250288 | 5/1975 | France | 273/1 E |
| 14642 | of 1897 | United Kingdom | 340/399 |
| 955784 | 4/1964 | United Kingdom | 273/375 |
| 1533473 | 11/1978 | United Kingdom | 273/1 R |

*Primary Examiner*—Paul E. Shapiro

*Attorney, Agent, or Firm*—Romney, Golant, Disner & Ashen

[57] ABSTRACT

A surprise action game comprising a play area which may depict an environment such as a spider web and includes electrically conductive portions. Play objects, as for example toy insects, having at least some electrically non-conductive portions are disposed on the spider web area. A manually moveable member is provided to pickup, move or otherwise manipulate the play objects. The member has an electrically conductive portion which comes into close proximity to the electrically conductive portions of the web area incident to the manipulation; if these electrically conductive portions make contact, a circuit is completed to energize a motor, which in turn drives an arm to suddenly flip or propel a surprise object such as a spider onto the web area.

35 Claims, 6 Drawing Figures

SURPRISE ACTION GAME

There have been various games in the prior art where the user attempted to manipulate objects, as for example attempting to pick up objects or move them along a designated path, without causing contact between electrically conductive elements. If such contact was made, a buzzer would sound and/or a light would go on to indicate the contact.

The present invention contemplates a novel and improved game apparatus which in broad terms provides a mechanical action effect in response to the completion of the circuit in such a device. In the illustrated presently preferred form, the effect is created by energizing a motor and thereby rotating an arm secured to the motor shaft. The arm in turn engages an object such as a molded plastic spider which is propelled generally upwardly and forwardly by the arm onto a play area, such as the one simulating the appearance of a spider web, where the child/user is doing the manipulation and has his or her hand located. The action is very fast and without warning. In the preferred aspect of the device, the "jumps" of the spider vary from time to time, to create a very lifelike effect. Thus, an extremely scary and exciting effect is created by use of a relative simple and inexpensive construction. A simple and inexpensive DC motor is powered by batteries contained by the device. When electrical contact is inadvertently made, a circuit is completed and the motor is energized which rotates the motor shaft and an arm fixed to the shaft. The arm engages and propels the surprise object such as the spider. The normal reaction of the child when the spider "jumps" down upon his hand is to quickly pull back his hand and remove the manipulating member from contact with the conductive portion of the spider web area; thus, power is used for only a very short period of time with the result and advantage that the batteries do not have a chance to heat up and will therefore last for a long time. Further, this arrangement involves no "on/off" switch, which helps to further reduce the cost. As will be discussed more fully below, the apparatus operates to impart different jumps to the spider thereby increase the realism and excitement of the game. In a preferred aspect, the spider is located somewhat above the spider web area and it is in no way connected to the remainder of the apparatus so that it jumps up and forward and then down onto the spider web area. This arrangement provides a highly effective visual effect.

IN THE DRAWINGS

Figure 1:
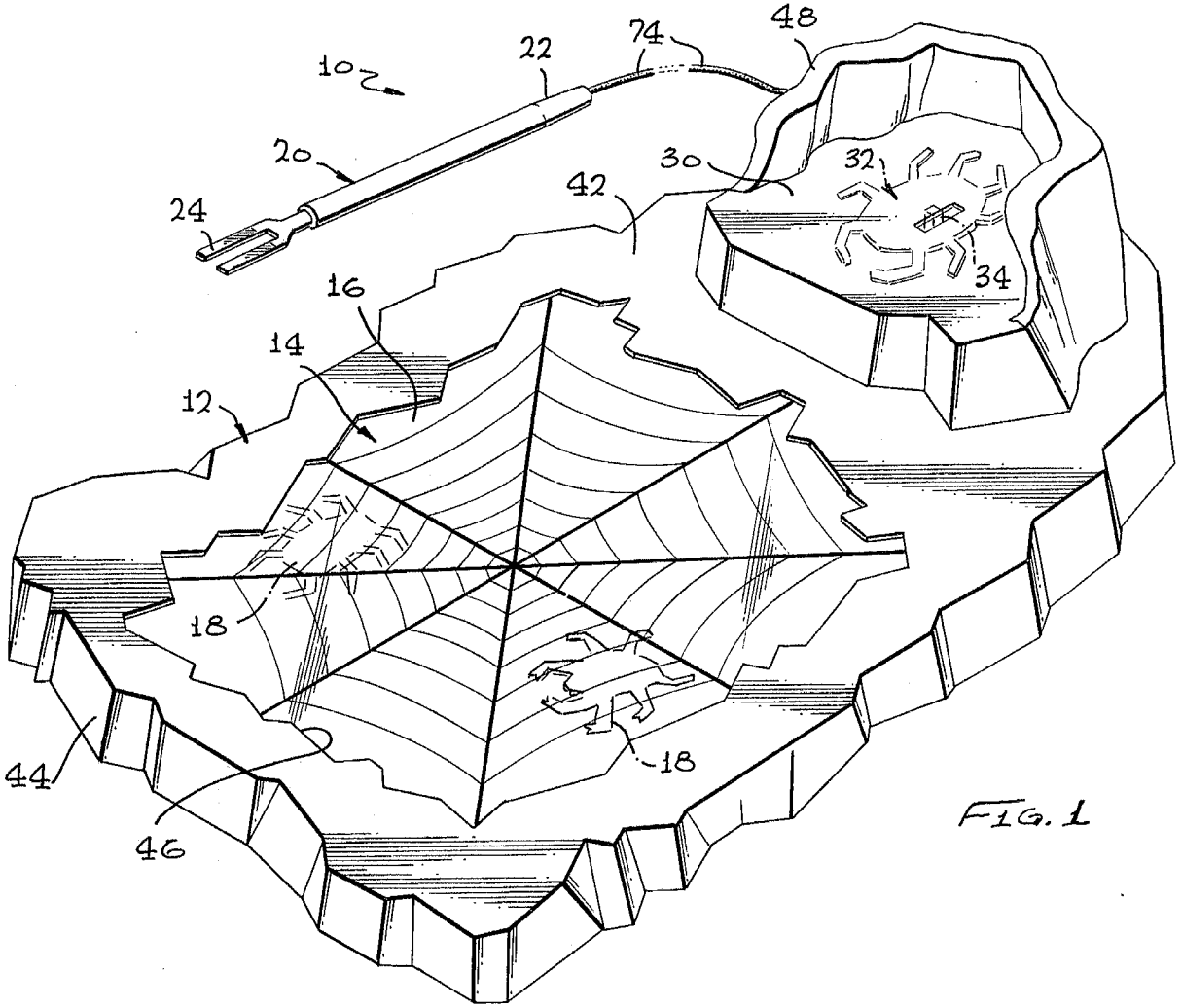
FIG. 1 is a perspective view of a spider web game apparatus embodying a presently preferred form of the invention.
Figure 2:
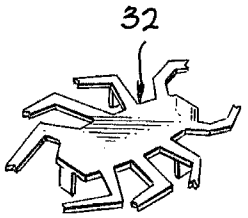
FIG. 2 is a perspective view of the action object or spider of the game of FIG. 1.

The presently preferred form of the invention is depicted in one embodiment in the drawings, and is designated generally by the numeral 10. Broadly, play apparatus 10 comprises a base 12 which supports a play area 14 which is illustrated as depicting a spider web. The illustrated play area 14 is provided with an electrically conductive upper surface 16. Disposed upon the spider web are a plurality of play objects in the form of insects 18 molded from soft plastic so as to be non-electrically conductive. The illustrated apparatus further includes a pick-up tool 20 having a handle 22 for being manually held and a fork-shaped pick-up end 24 of electrically conductive material. The user grasps the tool 20 and attempts to use the pick-up end 24 to lift the plastic insects 18 from the spider web area without bringing the electrically conductive pick-up end 24 into contact with the electrically conductive web surface 16. These electrically conductive portions 16 and 24 are both in an electrical circuit with batteries 28 and a DC motor 26 (FIGS. 3–5) such that when the end 24 comes into contact with the web surface 16, the circuit is completed and the motor is energized. The motor 26 is positioned within the base 12 immediately below an elevated platform 30 on which a surprise object such as a molded plastic spider 32 sits. A striker arm 34 is connected to the shaft 36 of the motor 26 and there is an aperture 38 in the platform aligned with the striker arm and below where the spider 32 sits. Rotation of the striker arm 34 causes its end portion 40 to pass upwardly through the aperture 38 and to engage the spider and propel it upwardly and forwardly toward the web area 14. As soon as electrical contact is broken between the pick-up end 24 and the web surface 16, the circuit is broken and the motor 26 stops. The spider is then replaced at its perch on the platform 30 and play of the game resumes.

Now to consider the illustrated structure 10 in further detail. The illustrated base 12 may be made of a suitable material such as molded plastic. As shown best in FIGS. 1 and 3, the base 12 has a generally rectangular but irregularly-shaped top wall 42 and a depending peripheral side wall 44. The base is formed to depict a rocky or cragy environment. There is a large generally rectangular but again irregular-shaped opening 46 in the top wall 42 for affording access to the spider web 14. This opening 46 is located at the front end of the base while the elevated platform 30 is located at the rear end of the base. More particularly, the platform itself is a generally flat surface having a somewhat irregular contour as seen best in FIG. 1. A depending peripheral side wall 48 supports the platform 30 above the top wall 42 of the base. Around the sides and rear of the platform 30 the side wall 48 extends above the height of the platform to somewhat enclose the platform. The front edge of the platform facing the spider web is not enclosed, however, to provide a clear and unobstructed route for the travel of the spider from the platform onto the spider web. The platform 30 and adjacent side wall 48 may be interally formed with the remainder of the base.

Figure 3:
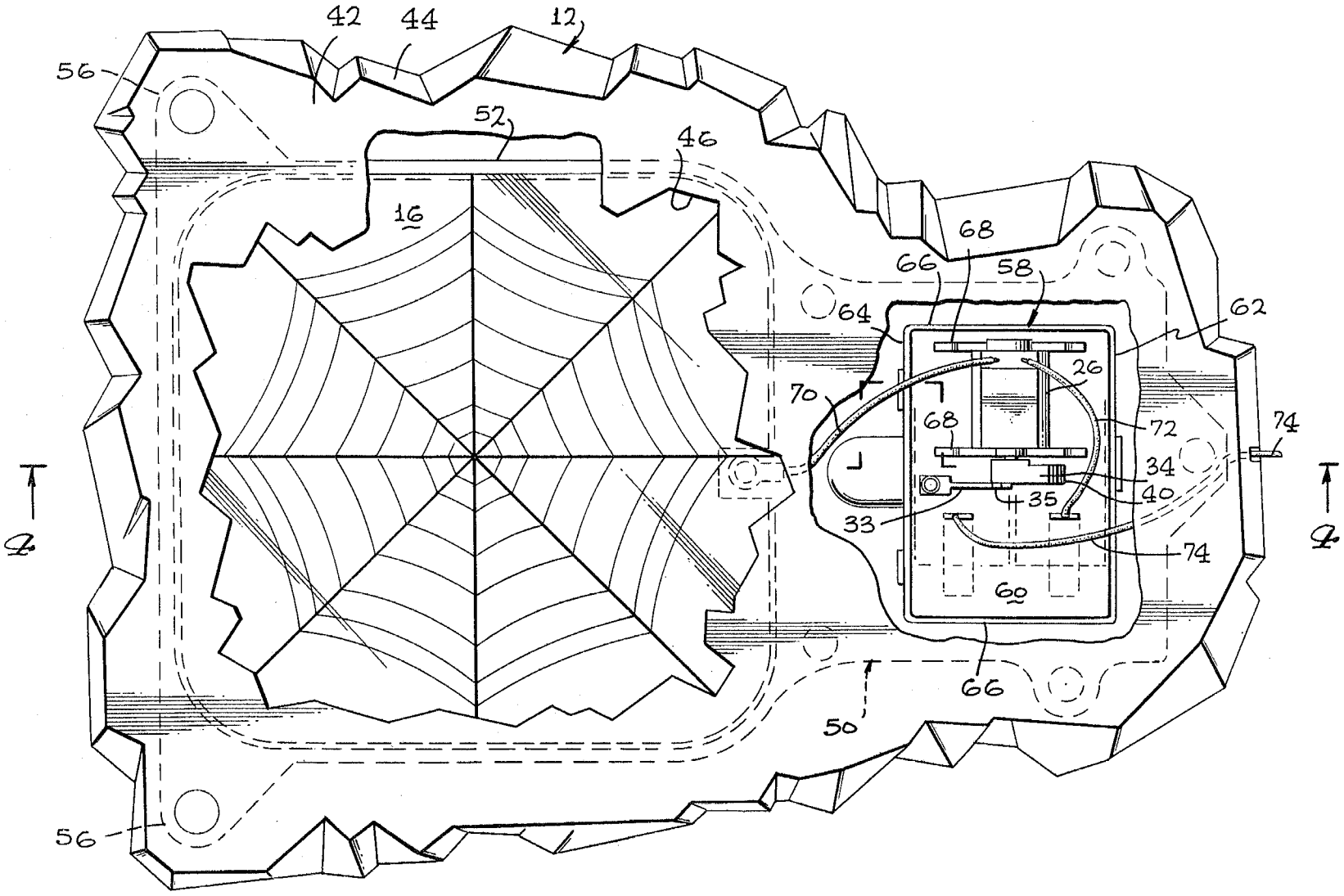
FIG. 3 is an enlarged top playing view, with portions broken away, of the game apparatus of FIG. 1.
Figure 6:
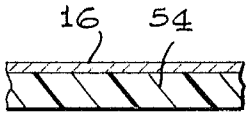
FIG. 6 is a fragmentary sectional view view taken generally along line 6—6 of FIG. 4.
Figure 5:
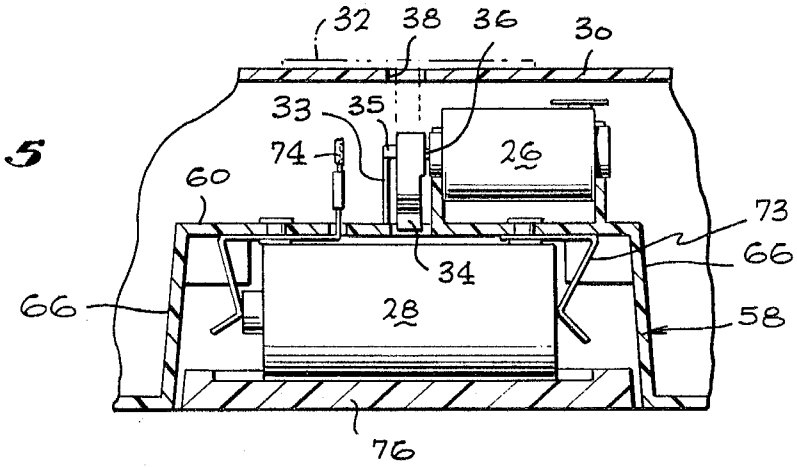
FIG. 5 is a transverse vertical section taken generally along line 5—5 of FIG. 4.
Figure 4:
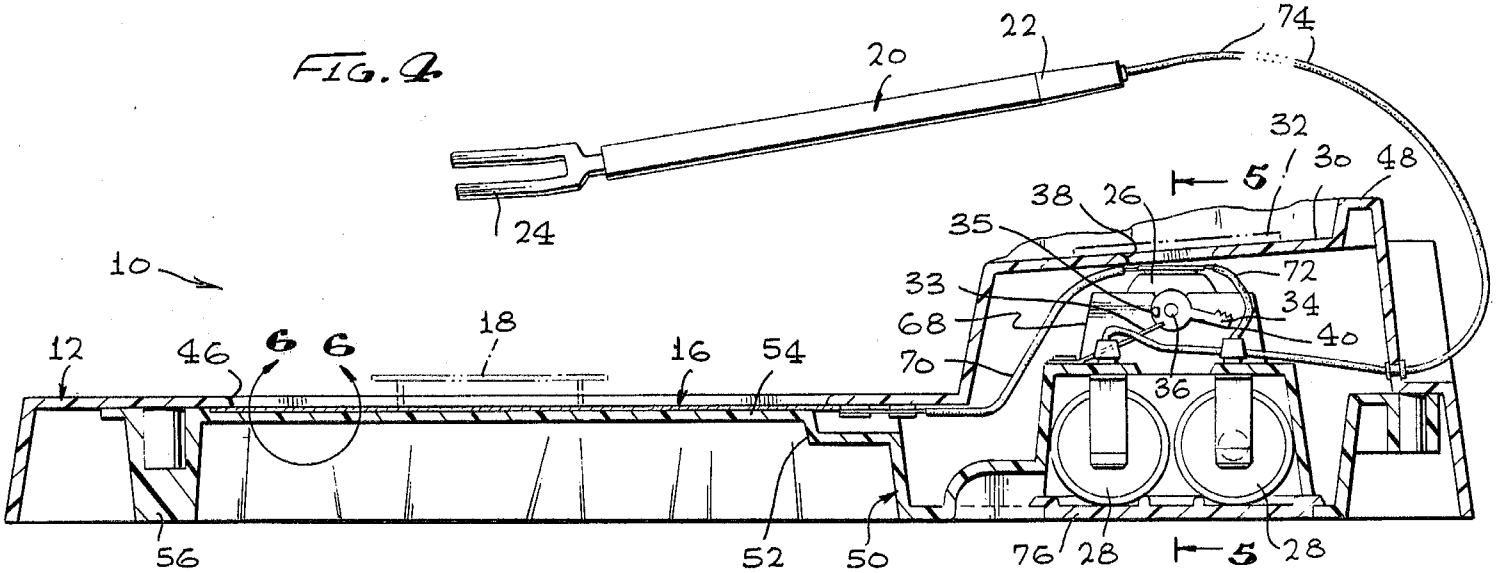
FIG. 4 is a vertical cross-section taken generally along line 4—4 of FIG. 3.

As shown best in FIGS. 3 and 4, an interior frame 50 is secured within the base 12 to provide support for the motor and batteries, and for the other portions of the electrical circuit including the spider web surface 16. More particularly, the interior frame 50 has a generally rectangular forward portion 52 with a top wall 54 that underlies the opening 46 in the base. The electrically conductive surface 16 is provided by a sheet of metal foil which depicts a spider web on its upper surface. The sheet is supported upon the top wall 54 and is visible and accessible through the base opening 46. A pair of support legs 56 are provided adjacent to the forward corners of the frame 50. Both the frame 50 and the base 12 are somewhat narrower towards the rear as seen best in FIG. 3. The frame 50 is formed with a generally rectangular box-like rear compartment 58 at its rearward end. This compartment 58 has a top wall 60, a rear wall 62, a front wall 64, and a pair of end walls 66. The compartment 58 is adapted to receive a pair of size C dry cell batteries 28. On the top wall 60 there are a pair of spaced apart upstanding support brackets 68 extending front to rear. These brackets 68 support the DC motor 26. One electrical lead 70 extends from the foil sheet 16 of the spider web to the motor. Another lead 72 extends from the motor to the rearward one of the batteries. The batteries are electrically interconnected to one another by a contact member 73 (FIG. 5). The forward battery is connected by another lead 74 to the pick-up tool 20. This last lead 74 extends through a suitable opening in the rear side wall 48 of the base, and is sufficiently long to permit adequate manipulation of the tool by the user. A suitable removable cover 76 may be provided across the bottom of the compartment 58 to permit replacement of the batteries if necessary.

The shaft 36 of the motor is secured to the striker arm 34. As viewed in FIG. 4, when the motor is energized, the arm rotates in the counter-clockwise direction with its end portion 40 passing upwardly and forwardly through the aperture 38 in the platform 30 and engaging the underside of the spider to propel it upwardly and forwardly onto the spider web area. The end portion 40 may have a serrated contact surface to enhance the contact when it engages the spider. It will be noted that the striker arm may stop in different locations after each energization of the motor, which results in the next strike being a function of where the arm started prior to the strike. The jumps also vary as a function of the contact made between the pickup end 24 and the web surface 16. In other words, if a solid contact is made, the motor will react vigorously and impart a more vigorous jump to the spider, whereas if only a slighter incidental contact is made the impact will be of a lesser quality. These variables provide significant variations in the path or flight of the spider from the platform and add to the realistic impression created by the jumping of the spider. Further, the action of the motor and striker arm are rapid and without advance warning, to further simulate the realistic jumping of a spider under its own motivation. A noise-maker may be provided to produce a sound as the spider jumps. In the illustrated apparatus (FIGS. 3–5) a reed 33 is mounted at one end on wall 60 and the other free end is positioned to be engaged by a tab 35 fixed on the motor shaft 36, to produce a sound when the motor is energized.

As noted above, the base and also the inner frame may be made from molded plastic or other suitable material. The play objects or insects, as well as the surprise object or spider, may conveniently be soft plastic parts which are cheap and safe as well as being electrically non-conductive.

In the play of the illustrated game, one player may pickup as many insects as he or she can before the spider jumps. A jump may require that players return one or more insects to the web area. Then the next player takes a turn. There may be various ways of keeping score, i.e., points for each insect successfully picked up, and/or loss of some or all points when spider jumps. Alternatively, players could alternate turns, each player having a turn to successfully pick up one or a designated number of insects; if the spider jumps, that player is eliminated and play continues until there is only one player left (the winner).

It will be appreciated that the variations may be made in the particular structure shown and described without departing from the spirit and scope of the present invention as set forth in the following claims. By way of example, instead of driving a striker arm directly, the action of the motor could operate through various mechanisms as for example by releasing a cocked spring-loaded arm. Further, while a motor is preferred because of its low cost and power requirements, it would be possible if desired or necessary for other reasons to use other electrically actuated devices such as a solenoid.

Also by way of example, while having the spider free and unconnected to the remainder of the device is preferred and provides a very good visual effect, in some circumstances and conditions some connection might be desired. For example, it might be desired to use a tether of some kind to prevent the spider from being separated from the apparatus and lost. Further, by way of another example, some pivoted arrangement might be utilized where the movement was not free but revolved around a fixed axis. Also, possibly the electrical contact might trigger an "avalanche" which boulders moving down a hillside as by means of the operation of a continuous belt to which the boulders were secured. As another example, the surprise action might involve a toy figure falling off a ladder whereby the ladder was pivoted and when the motor was actuated the ladder swung from an upright to a tipped-over condition. Thus, various other mechanical "surprise" action effects might take place. Further, the general format or environment may well vary from the spider and spider-web depicted in the illustrated structure, all without departing from the claimed invention.

Still further, while a "pick-up" tool is illustrated, the play objects may instead be moved along a pathway defined by the play area; the pathway could incorporate obstacles. While it is convenient and preferred that the platform and play area comprise a single structure, it would be possible for them to be separate structures connected only by wiring.

We claim:

1. A surprise action game apparatus comprising;

(a) a play surface having electrically conductive contact means thereon;

(b) one or more play objects disposed upon the play surface, said object having electrically non-conductive means thereon;

(c) manually operable means for manipulating said play object, said manually operable means including an electrically conductive portion which comes into close proximity to said contact means incident to manipulation of the play object;

(d) an electrical motive means disposed adjacent to said play surface and electrically connected to said electrically conductive contact means and said electrically conductive portion so as to be energized when said two last-mentioned means contact one another;

(e) mechanical flipper means operatively connected to said motive means for being actuated when said motive means is energized; and (f) a surprise object disposed adjacent said flipper means for being propelled onto said play surface by said flipper means when it is actuated by said motive means.

2. The game apparatus of claim 1 wherein said play surface is made of an electrically conductive material.

3. The game apparatus of claim 2 wherein said electrically conductive material is a sheet of metal foil.

4. The game apparatus of claim 1 wherein said play object is made of an electrically non-conductive material.

5. The game apparatus of claim 4 wherein said object is made of a soft molded plastic.

6. The game apparatus of claim 1 wherein said motive means is a motor.

7. The game apparatus of claim 6 wherein said flipper means comprises an elongated arm fixed to the shaft of said motor.

8. The game apparatus of claim 7 wherein said apparatus further comprises a platform disposed above said motor for supporting said surprise object, and said platform includes an aperture through which said arm passes to propel the surprise object upwardly and in a transverse direction.

9. The game apparatus of claim 8 wherein said platform is elevated above said play surface and said striker arm propels said surprise object transversely toward said play surface.

10. The game apparatus of claim 6 wherein said motor has a shaft and an element on said shaft, and a reed is disposed to be engaged by said element when the motor is energized to produce a sound.

11. The game apparatus of claim 7 wherein said arm is permitted to come to rest after each operation in a non-predetermined position at least partially defined by the nature and duration of contact between the contact means of the play surface and the conductive portion of the manually operable means, whereby subsequent propelling of the surprise object varies from time to time.

12. The game apparatus of claim 8 wherein said play surface and said platform are both supported on a common base.

13. The game apparatus of claim 12 wherein said surprise object is connected to said base by a tether.

14. The game apparatus of claim 1 wherein said surprise object is separate and unconnected to the remainder of said game apparatus.

15. The game apparatus of claim 1 further including means for producing a sound when said motor is energized.

16. The game apparatus as set forth in claim 1 wherein said play surface depicts a spider web, said play object depicts an insect, and said surprise object depicts a spider.

17. A surprise action game apparatus comprising:

(a) a play surface having electrically conductive contact means thereon and adapted to receive one or more play objects, said object having electrically non-conductive means thereon;

(b) manually operable means for manipulating said play object, said manually operable means including an electrically conductive portion which comes into close proximity to said contact means incident to manipulation of the play object;

(c) means for releasibly supporting a surprise object at a position spaced from said play surface;

(d) a motor disposed adjacent to said play surface and to said supporting means, and electrically connected to said electrically conductive contact means and said electrically conductive portion so as to be energized when said two last-mentioned means contact one another; and (e) an elongated arm fixed to the shaft of said motor for striking and propelling said surprise object from said supporting means onto said play surface when motor is energized.

18. The game apparatus of claim 17 wherein said play surface is made of an electrically conductive material.

19. The game apparatus of claim 18 wherein said electrically conductive material is a sheet of metal foil.

20. The game apparatus of claim 17 further including a plurality of objects and a surprise object.

21. The game apparatus of claim 20 wherein said objects are made of a soft molded plastic.

22. The game apparatus of claim 17 wherein said surprise object is separate and unconnected to the remainder of said game apparatus.

23. The game apparatus of claim 17 wherein said arm is permitted to come to rest after each operation in a non-predetermined position at least partially defined by the nature and duration of contact between the contact means of the play surface and the conductive portion of the manually operable means, whereby subsequent propelling of the surprise object varies from time to time.

24. A surprise action game apparatus comprising:

(a) a play surface having electrically conductive contact means thereon and adapted to receive one or more play objects, said object having electrically non-conductive means thereon;

(b) manually operable means for manipulating said play object, said manually operable means including an electrically conductive portion which comes into close proximity to said contact means incident to manipulation of the play object;

(c) a motor disposed adjacent to said play surface and electrically connected to said electrically conductive contact means and said electrically conductive portion so as to be energized when said two last-mentioned means contact one another; and (d) an elongated arm fixed to the shaft of said motor for striking and propelling a surprise object onto said play surface when said motor is energized, said apparatus further comprises a platform disposed above said motor for supporting said surprise object, and said platform includes an aperture through which said arm passes to propel the surprise object upwardly and in a transverse direction.

25. The game apparatus of claim 24 wherein said platform is elevated above said play surface and said striker arm propels said surprise object transversely toward said play surface.

26. The game apparatus of claim 24 wherein said platform and said play surface are both supported on a common base.

27. A surprise action game apparatus comprising:

(a) a play surface having electrically conductive contact means thereon and adapted to receive one or more play objects, said object having electrically non-conductive means thereon;

(b) manually operable means for manipulating said play object, said manually operable means including an electrically conductive portion which comes into close proximity to said contact means incident to manipulation of the play object;

(c) a surprise element and means for releasibly supporting said surprise element at a first position spaced from said play surface;

(d) electrical motive means disposed adjacent to said play surface and to said supporting means and electrically connected to said electrically conductive contact means and said electrically conductive portion means so as to be energized when said two last-mentioned means contact one another; and (e) a surprise action device operatively associated with said motive means so as to be actuated, when said motive means is energized, to cause rapid movement of said surprise element from said first position at said supporting means to a second position on said play surface.

28. The game apparatus of claim 27 wherein said play surface is made of an electrically conductive material.

29. The game apparatus of claim 28 wherein said electrically conductive material is a sheet of metal foil.

30. The game apparatus of claim 27 including surprise and play objects made entirely of an electrically non-conductive material.

31. The game apparatus of claim 27 wherein said mechanical surprise action device comprises an elongated arm fixed to the shaft of said motive means.

32. The game apparatus in claim 31 wherein said arm is permitted to come to rest after each operation in a non-predetermined position at least partially defined by the nature and duration of contact between the contact means of the play surface and the conductive portion of the manually operable means, whereby subsequent propelling of the surprise object varies from time to time.

33. A surprise action game apparatus comprising:

(a) a play surface having electrically conductive contact means thereon and adapted to receive one or more play objects, said object having electrically non-conductive means thereon;

(b) manually operable means for manipulating said play object, said manually operable means including an electrically conductive portion which comes into close proximity to said contact means incident to manipulation of the play object;

(c) a motor disposed adjacent to said play surface and electrically connected to said electrically conductive contact means and said electrically conductive portion means so as to be energized when said two last-mentioned means contact one another; and (d) a mechanical surprise action device operatively associated with said motor so as to be actuated to produce a sudden surprise action effect when said motor is energized, said mechanical surprise action device comprising an elongated arm fixed to the shaft of said motor, said apparatus further comprises a platform disposed adjacent to said motor for supporting a surprise object in a position to be engaged by said arm and propelled from said platform when said motor is energized.

34. The game apparatus of claim 33 wherein said platform is elevated above said motor and said striker arm propels said surprise object upwardly and transversely.

35. The game apparatus of claim 33 including a surprise object separate and unconnected to the remainder of said game apparatus.

* * * * *